US006232570B1

(12) United States Patent
Castonguay et al.

(10) Patent No.: US 6,232,570 B1
(45) Date of Patent: May 15, 2001

(54) ARCING CONTACT ARRANGEMENT

(75) Inventors: Roger Castonguay, Terryville, CT (US); Stefan Kranz, Eutin (DE); Randy Greenberg, Granby; Dave Christensen, Sandy Hook, both of CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/397,683

(22) Filed: Sep. 16, 1999

(51) Int. Cl.[7] ..... H01H 1/12; H01H 9/30

(52) U.S. Cl. ..... 218/146; 200/237

(58) Field of Search ..... 218/7, 22–32, 218/48–50, 74, 146, 147, 149–157; 200/237–252, 500–572

(56) References Cited

U.S. PATENT DOCUMENTS

| | | | |
|---|---|---|---|
| D. 367,265 | 2/1996 | Yamagata et al. | D13/160 |
| 2,340,682 | 2/1944 | Powell | 200/147 |
| 2,719,203 | 9/1955 | Gelzheiser et al. | 200/144 |
| 2,937,254 | 5/1960 | Ericson | 200/114 |
| 3,158,717 | 11/1964 | Jencks et al. | 200/116 |
| 3,162,739 | 12/1964 | Klein et al. | 200/88 |
| 3,197,582 | 7/1965 | Norden | 200/50 |
| 3,307,002 | 2/1967 | Cooper | 200/116 |
| 3,517,356 | 6/1970 | Hanafusa | 335/16 |
| 3,631,369 | 12/1971 | Menocal | 337/110 |
| 3,803,455 | 4/1974 | Willard | 317/33 SC |
| 3,883,781 | 5/1975 | Cotton | 317/14 R |
| 4,129,762 | 12/1978 | Bruchet | 200/153 G |

(List continued on next page.)

FOREIGN PATENT DOCUMENTS

| | | |
|---|---|---|
| 897 691 | of 0000 | (BE) . |
| 819 008 | 12/1974 | (BE) . |
| 12 27 978 | 11/1966 | (DE) . |
| 30 47 360 | 6/1982 | (DE) . |
| 38 02 184 | 8/1989 | (DE) . |
| 38 43 277 | 6/1990 | (DE) . |
| 44 19 240 | 1/1995 | (DE) . |
| 207 128 | 9/1939 | (EP) . |
| 19 09 358 U | 2/1965 | (EP) . |
| 0 061 092 | 9/1982 | (EP) . |
| 0 064 906 | 11/1982 | (EP) . |
| 0 066 486 | 12/1982 | (EP) . |
| 0 076 719 | 4/1983 | (EP) . |
| 0 080 924 A1 | 6/1983 | (EP) . |
| 0 117 094 | 8/1984 | (EP) . |

*Primary Examiner*—J. R. Scott
(74) *Attorney, Agent, or Firm*—Cantor Colburn LLP; Carl B. Horton

(57) ABSTRACT

A rotary double-break circuit breaker includes a case defining a circuit breaker enclosure with a rotatable bridge and contact arm arrangement. The contact arm having movable contacts which is rotatable between a closed position and an open position. A pair of stationary contacts cooperate with the movable contacts, and a conductor is operatively connected to each of the stationary contacts for current input thereto. Each of the movable contacts includes a heel portion and a toe portion, the heel portion contacting one of the stationary contacts and the toe portion spaced from the stationary contact when the contact bridge is in closed position, the movable contact being angled or curved relative to the stationary contact such that upon the contact bridge rotating to disengage the movable contacts from the stationary contacts, an electric arc formed between the movable contact and the stationary contact runs to the toe portion of the movable contact thereby protecting the heel portion from substantial damage.

17 Claims, 4 Drawing Sheets

U.S. PATENT DOCUMENTS

| | | | |
|---|---|---|---|
| 4,144,513 | 3/1979 | Shafer et al. | 335/46 |
| 4,158,119 | 6/1979 | Krakik | 200/240 |
| 4,165,453 | 8/1979 | Henneman | 200/153 G |
| 4,166,988 | 9/1979 | Ciarcia et al. | 335/9 |
| 4,220,934 | 9/1980 | Wafer et al. | 335/16 |
| 4,255,732 | 3/1981 | Wafer et al. | 335/16 |
| 4,259,651 | 3/1981 | Yamat | 335/16 |
| 4,263,492 | 4/1981 | Maier et al. | 200/288 |
| 4,276,527 | 6/1981 | Gerbert-Gaillard et al. | 335/39 |
| 4,297,663 | 10/1981 | Seymour et al. | 335/20 |
| 4,301,342 | 11/1981 | Castonguay et al. | 200/153 SC |
| 4,360,852 | 11/1982 | Gilmore | 361/98 |
| 4,368,444 | 1/1983 | Preuss et al. | 335/166 |
| 4,375,021 | 2/1983 | Pardini et al. | 200/147 B |
| 4,375,022 | 2/1983 | Daussin et al. | 200/148 R |
| 4,376,270 | 3/1983 | Staffen | 335/21 |
| 4,383,146 | 5/1983 | Bur | 200/17 R |
| 4,392,036 | 7/1983 | Troebel et al. | 200/322 |
| 4,393,283 | 7/1983 | Masuda | 200/51.09 |
| 4,401,872 | 8/1983 | Boichot-Castagne et al. | 200/153 G |
| 4,409,573 | 10/1983 | DiMarco et al. | 335/16 |
| 4,435,690 | 3/1984 | Link et al. | 335/37 |
| 4,467,297 | 8/1984 | Boichot-Castagne et al. | 335/8 |
| 4,468,645 | 8/1984 | Gerber-Gaillard et al. | 335/42 |
| 4,470,027 | 9/1984 | Link et al. | 335/16 |
| 4,479,143 | 10/1984 | Watanabe et al. | 358/44 |
| 4,488,133 | 12/1984 | McClellan et al. | 335/16 |
| 4,492,941 | 1/1985 | Nagel | 335/13 |
| 4,541,032 | 9/1985 | Schwab | 361/351 |
| 4,546,224 | 10/1985 | Mostosi | 200/153 G |
| 4,550,360 | 10/1985 | Dougherty | 361/93 |
| 4,562,419 | 12/1985 | Preuss et al. | 335/195 |
| 4,589,052 | 5/1986 | Dougherty | 361/94 |
| 4,595,812 | 6/1986 | Tamaru et al. | 200/307 |
| 4,611,187 | 9/1986 | Banfi | 335/16 |
| 4,612,430 | 9/1986 | Sloan et al. | 200/327 |
| 4,616,198 | 10/1986 | Pardini | 335/16 |
| 4,622,444 | 11/1986 | Kandatsu et al. | 200/303 |
| 4,631,625 | 12/1986 | Alexander et al. | 361/94 |
| 4,642,431 | 2/1987 | Tedesco et al. | 200/153 G |
| 4,644,438 | 2/1987 | Puccinelli et al. | 361/75 |
| 4,649,247 | 3/1987 | Preuss et al. | 200/244 |
| 4,658,322 | 4/1987 | Rivera | 361/37 |
| 4,672,501 | 6/1987 | Bilac et al. | 361/96 |
| 4,675,481 | 6/1987 | Markowski et al. | 200/144 R |
| 4,682,264 | 7/1987 | Demeyer | 361/96 |
| 4,689,712 | 8/1987 | Demeyer | 361/96 |
| 4,694,373 | 9/1987 | Demeyer | 361/96 |
| 4,710,845 | 12/1987 | Demeyer | 361/96 |
| 4,717,985 | 1/1988 | Demeyer | 361/96 |
| 4,733,211 | 3/1988 | Castonguay et al. | 335/192 |
| 4,733,321 | 3/1988 | Lindeperg | 361/96 |
| 4,764,650 | 8/1988 | Bur et al. | 200/153 G |
| 4,768,007 | 8/1988 | Mertz et al. | 335/202 |
| 4,780,786 | 10/1988 | Weynachter et al. | 361/87 |
| 4,831,221 | 5/1989 | Yu et al. | 200/553 |
| 4,870,531 | 9/1989 | Danek | 361/93 |
| 4,883,931 | 11/1989 | Batteux et al. | 200/148 R |
| 4,884,047 | 11/1989 | Baginski et al. | 335/10 |
| 4,884,164 | 11/1989 | Dziura et al. | 361/97 |
| 4,900,882 | 2/1990 | Bernard et al. | 200/147 R |
| 4,910,485 | 3/1990 | Bolongeat-Mobleu et al. | 335/195 |
| 4,914,541 | 4/1990 | Tripodi et al. | 367/94 |
| 4,916,420 | 4/1990 | Bartolo et al. | 335/172 |
| 4,916,421 | 4/1990 | Pardini et al | 335/185 |
| 4,926,282 | 5/1990 | McGhie | 361/102 |
| 4,935,590 | 6/1990 | Malkin et al. | 200/148 A |
| 4,937,706 | 6/1990 | Schueller et al. | 361/396 |
| 4,939,492 | 7/1990 | Raso et al. | 335/42 |
| 4,943,691 | 7/1990 | Mertz et al. | 200/151 |
| 4,943,888 | 7/1990 | Jacob et al. | 361/96 |
| 4,950,855 | 8/1990 | Bolonegeat-Mobleu et al. | 200/148 A |
| 4,951,019 | 8/1990 | Gula | 335/166 |
| 4,952,897 | 8/1990 | Barnel et al. | 335/147 |
| 4,958,135 | 9/1990 | Baginski et al. | 335/8 |
| 4,965,543 | 10/1990 | Batteux | 335/174 |
| 4,983,788 | 1/1991 | Pardini | 200/16 R |
| 5,001,313 | 3/1991 | Leclerq et al. | 200/148 B |
| 5,004,878 | 4/1991 | Seymour et al. | 200/144 R |
| 5,029,301 | 7/1991 | Nebon et al. | 335/16 |
| 5,030,804 | 7/1991 | Abri | 200/323 |
| 5,057,655 | 10/1991 | Kersusan et al. | 200/148 B |
| 5,077,627 | 12/1991 | Fraisse | 361/93 |
| 5,083,081 | 1/1992 | Barrault et al. | 324/126 |
| 5,095,183 | 3/1992 | Raphard et al. | 200/148 A |
| 5,103,198 | 4/1992 | Morel et al. | 335/6 |
| 5,115,371 | 5/1992 | Tripodi | 361/106 |
| 5,120,921 | 6/1992 | DiMarco et al. | 200/401 |
| 5,132,865 | 7/1992 | Mertz et al. | 361/6 |
| 5,138,121 | 8/1992 | Streich et al. | 200/293 |
| 5,140,115 | 8/1992 | Morris | 200/308 |
| 5,153,802 | 10/1992 | Mertz et al. | 361/18 |
| 5,155,315 | 10/1992 | Malkin et al. | 200/148 R |
| 5,166,483 | 11/1992 | Kersusan et al. | 200/144 A |
| 5,172,087 | 12/1992 | Castonguay et al. | 335/160 |
| 5,178,504 | 1/1993 | Falchi | 411/553 |
| 5,184,717 | 2/1993 | Chou et al. | 200/401 |
| 5,187,339 | 2/1993 | Lissandrin | 200/148 F |
| 5,198,956 | 3/1993 | Dvorak | 361/106 |
| 5,200,724 | 4/1993 | Gula et al. | 335/166 |
| 5,210,385 | 5/1993 | Morel et al. | 200/146 R |
| 5,239,150 | 8/1993 | Bolongeat-Mobleu et al. | 200/148 R |
| 5,260,533 | 11/1993 | Livesey et al. | 200/401 |
| 5,262,744 | 11/1993 | Arnold et al. | 335/8 |
| 5,280,144 | 1/1994 | Bolongeat-Mobleu et al. | 200/148 R |
| 5,281,776 | 1/1994 | Morel et al. | 200/144 |
| 5,296,660 | 3/1994 | Morel et al. | 200/146 R |
| 5,296,664 | 3/1994 | Crookston et al. | 200/401 |
| 5,298,874 | 3/1994 | Morel et al. | 335/8 |
| 5,300,907 | 4/1994 | Nereau et al. | 335/172 |
| 5,310,971 | 5/1994 | Vial et al. | 200/244 |
| 5,313,180 | 5/1994 | Vial et al. | 335/16 |
| 5,317,471 | 5/1994 | Izoard et al. | 361/105 |
| 5,331,500 | 7/1994 | Corcoles et al. | 361/93 |
| 5,334,808 | 8/1994 | Bur et al. | 200/50 |
| 5,341,191 | 8/1994 | Crookston et al. | 335/16 |
| 5,347,096 | 9/1994 | Bolongeat-Mobleu et al. | 200/148 B |
| 5,347,097 | 9/1994 | Bolongeat-Mobleu et al. | 200/148 B |
| 5,350,892 | 9/1994 | Rozier | 200/144 B |
| 5,357,006 | 10/1994 | Morel et al. | 200/17 R |
| 5,357,066 | 10/1994 | Morel et al. | 200/17 R |
| 5,357,068 | 10/1994 | Rozier | 200/148 R |
| 5,357,394 | 10/1994 | Piney | 361/72 |
| 5,361,052 | 11/1994 | Ferullo et al. | 335/172 |
| 5,373,130 | 12/1994 | Barrault et al. | 200/147 R |
| 5,379,013 | 1/1995 | Coudert | 335/17 |
| 5,424,701 | 6/1995 | Castonguary et al. | 335/172 |
| 5,438,176 | 8/1995 | Bonnardel et al. | 200/400 |
| 5,440,088 | 8/1995 | Coudert et al. | 200/303 |
| 5,449,871 | 9/1995 | Batteux et al. | 200/401 |
| 5,450,048 | 9/1995 | Leger et al. | 335/132 |
| 5,451,729 | 9/1995 | Onderka et al. | 200/18 |
| 5,457,295 | 10/1995 | Tanibe et al. | 200/293 |
| 5,467,069 | 11/1995 | Payet-Burin et al. | 335/42 |
| 5,469,121 | 11/1995 | Payet-Burin | 335/16 |
| 5,475,558 | 12/1995 | Barjonnet et al. | 361/64 |
| 5,477,016 | 12/1995 | Baginski et al. | 200/43.11 |
| 5,479,143 | 12/1995 | Payet-Burin | 335/202 |
| 5,483,212 | 1/1996 | Lankuttis et al. | 335/132 |
| 5,485,343 | 1/1996 | Santos et al. | 361/115 |

| | | | | |
|---|---|---|---|---|
| 5,493,083 | | 2/1996 | Olivier | 200/17 R |
| 5,504,284 | | 4/1996 | Lazareth et al. | 200/50 R |
| 5,504,290 | | 4/1996 | Baginski et al. | 200/401 |
| 5,510,761 | | 4/1996 | Boder et al. | 335/172 |
| 5,512,720 | | 4/1996 | Coudert et al. | 200/400 |
| 5,515,018 | | 5/1996 | DiMarco et al. | 335/16 |
| 5,519,561 | | 5/1996 | Mrenna et al. | 361/105 |
| 5,534,674 | | 7/1996 | Steffens | 218/514 |
| 5,534,832 | | 7/1996 | Duchemin et al. | 335/16 |
| 5,534,835 | | 7/1996 | McColloch et al. | 335/172 |
| 5,534,840 | | 7/1996 | Cuingnet | 337/1 |
| 5,539,168 | | 7/1996 | Linzenich | 200/303 |
| 5,543,595 | | 8/1996 | Mader et al. | 200/401 |
| 5,552,755 | | 9/1996 | Fello et al. | 335/18 |
| 5,581,219 | | 12/1996 | Nozawa et al. | 335/132 |
| 5,604,656 | | 2/1997 | Derrick et al. | 361/187 |
| 5,608,367 | | 3/1997 | Zoller et al. | 335/132 |
| 5,784,233 | | 7/1998 | Bastard et al. | 361/36 |
| 5,969,314 | * | 10/1999 | Rakus et al. | 218/7 |
| 6,037,555 | * | 3/2000 | Castonguay et al. | 218/157 |
| 6,084,489 | * | 7/2000 | Castonguay et al. | 218/22 X |

FOREIGN PATENT DOCUMENTS

| | | |
|---|---|---|
| 0 140 761 | 5/1985 | (EP) . |
| 0 174 904 | 3/1986 | (EP) . |
| 0 196 241 | 10/1986 | (EP) . |
| 0 206 882 A1 | 12/1986 | (EP) . |
| 0 224 396 | 6/1987 | (EP) . |
| 0 235 479 | 9/1987 | (EP) . |
| 0 239 460 | 9/1987 | (EP) . |
| 0 258 090 | 3/1988 | (EP) . |
| 0 264 313 | 4/1988 | (EP) . |
| 0 264 314 | 4/1988 | (EP) . |
| 0 283 189 | 9/1988 | (EP) . |
| 0 283 358 | 9/1988 | (EP) . |
| 0 291 374 | 11/1988 | (EP) . |
| 0 295 155 | 12/1988 | (EP) . |
| 0 295 158 | 12/1988 | (EP) . |
| 0 309 923 | 4/1989 | (EP) . |
| 0 313 106 | 4/1989 | (EP) . |
| 0 313 422 | 4/1989 | (EP) . |
| 0 314 540 | 5/1989 | (EP) . |
| 0 331 586 | 9/1989 | (EP) . |
| 0 337 900 | 10/1989 | (EP) . |
| 0 342 133 | 11/1989 | (EP) . |
| 38 18 864 | 12/1989 | (EP) . |
| 0 367 690 | 5/1990 | (EP) . |
| 0 371 887 | 6/1990 | (EP) . |
| 0 375 568 | 6/1990 | (EP) . |
| 0 394 144 | 10/1990 | (EP) . |
| 0 394 922 | 10/1990 | (EP) . |
| 0 399 282 | 11/1990 | (EP) . |
| 0 407 310 | 1/1991 | (EP) . |
| 0 452 230 | 10/1991 | (EP) . |
| 0 555 158 | 8/1993 | (EP) . |
| 0 560 697 A1 | 9/1993 | (EP) . |
| 0 567 416 | 10/1993 | (EP) . |
| 0 595 730 | 5/1994 | (EP) . |
| 0 619 591 | 10/1994 | (EP) . |
| 0 665 569 | 8/1995 | (EP) . |
| 0 696 041 A1 | 2/1996 | (EP) . |
| 0 700 140 | 3/1996 | (EP) . |
| 0 889498 | 1/1999 | (EP) . |
| 2 410 353 | 6/1979 | (FR) . |
| 2 512 582 | 3/1983 | (FR) . |
| 2 553 943 | 4/1985 | (FR) . |
| 2 592 998 | 7/1987 | (FR) . |
| 2 682 531 | 4/1993 | (FR) . |
| 2 697 670 | 5/1994 | (FR) . |
| 2 699 324 | 6/1994 | (FR) . |
| 2 714 771 | 7/1995 | (FR) . |
| 548810 | 10/1942 | (GB) . |
| 2 233 155 | 1/1991 | (GB) . |
| 92/00598 | 1/1992 | (WO) . |
| 94/00901 | 4/1992 | (WO) . |
| 1 227 978 | 1/1994 | (WO) . |

* cited by examiner

ARCING CONTACT ARRANGEMENT

BACKGROUND OF THE INVENTION

The present invention relates generally to rotary circuit breakers and, more particularly, to an improved arcing contact arrangement for rotary breakers.

Rotary-type circuit breakers are known. A common problem encountered with such devices is the contact wear resulting from the arcing generated when the contacts are separated (tripped) under power. The intense temperature generated between contacts from the arcing results in erosion of the contact faces, which it is particularly problematic with respect to the movable contact which is necessarily less durable due to weight constraints imposed to allow the rotary bridge to rotate quickly. The movable contacts generally erode much more than the stationary contacts, necessitating replacement of the circuit breaker. There is therefore a need for a rotary-type circuit breaker which will greatly reduce the wear on the physical contact surfaces of the contacts and more particularly the movable contacts.

BRIEF SUMMARY OF THE INVENTION

In an exemplary embodiment of the invention a rotary double-break circuit breaker comprises a case defining a circuit breaker enclosure with a rotatable contact bridge mounted therein having opposite movable contacts, with improved wear features, which is rotatable between a closed position and an open position. A pair of stationary contacts cooperate with the movable contacts, and a conductor is operatively connected to each of the stationary contacts for current input thereto. Each of the movable contacts includes a heel portion and a toe portion, the heel portion contacting one of the stationary contacts and the toe portion spaced from the stationary contact when the contact bridge is in closed position, the movable contact being angled relative to the stationary contact such that upon the contact bridge rotating to disengage the movable contacts from the stationary contacts, an electric arc formed between the movable contact and the stationary contact runs to the toe portion of the movable contact thereby protecting the heel portion from substantial damage.

The present invention provides a substantial improvement over those devices found in the prior art. For example, because the arc is run off the toe portion (at the expense thereof) of the movable contact, the heel portion of the movable contact is left generally undamaged, thus increasing the usable life span of the circuit breaker and reducing the increase in temperature resulting from the erosion. Furthermore, because the movement of the arc into the arc chute is enhanced, the interruption performance of the circuit breaker is improved and lower post-short-circuit temperature rise is achieved. Finally, the enhancement of the movement of the arc into the arc chute will greatly reduce the chances for burning of the rotor. It is thus seen that the present invention provides a substantial improvement over those circuit breakers found in the prior art.

DESCRIPTION OF THE PREFERRED EMBODIMENT

Figure 1:
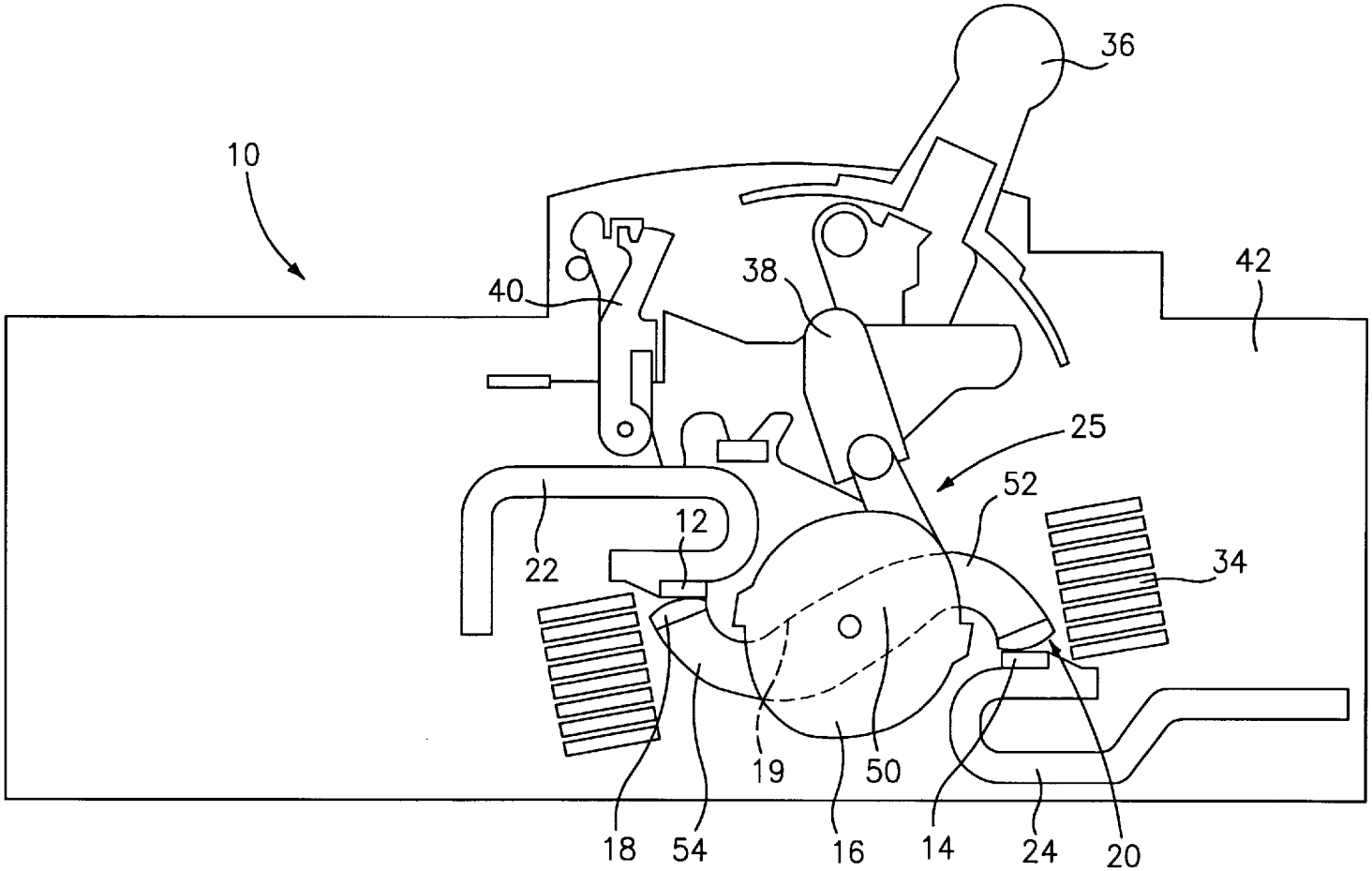
FIG. 1 is a diagrammatic side elevational view of a circuit breaker in accordance with the invention, with the contact bridge thereof in the closed position.

Referring to FIG. 1, a circuit breaker in accordance with the present invention is generally shown at 10. Circuit breaker 10 has a pair of stationary contacts 12 and 14 and a pair of movable contacts 18 and 20 which respectively engage stationary contacts 12 and 14. The movable contacts 18 and 20 are mounted on a contact arm 19 which is itself mounted in a rotatably mounted contact bridge 16. The contact arm 19 includes a central section 50, a first connecting arm 52 extending angularly from said central section 50 and a second connecting arm 54 extending angularly from said central section 50 in a direction diagonally opposite the first connecting arm 52. This arrangement being further described in U.S. patent application No. 6,114,641, issued on Sep. 5, 2000, entitled Rotary Contact Assembly For High Ampere-Rated Circuit Breakers which is incorporated by reference. The stationary contacts 12 and 14 are each mounted respectively on current input conductors 22 and 24 formed as reverse half-loops with the stationary contacts 12 and 14 mounted adjacent the ends thereof. When the circuit breaker 10 is in the closed position, it is seen that stationary contact 12 is in current transfer connection with movable contact 18 and likewise stationary contact 14 is in current transmission connection with movable contact 20. Current entering into the circuit breaker 10 would then pass through current input connector 22 through stationary contact 12 and movable contact 18 through contact arm 19 to movable contact 20 and then into stationary contact 14 and current input conductor 24 where it is conducted out of the circuit breaker 10.

The repelling force for opening the circuit breaker 10 under overload conditions is provided by the opposite polarity of the currents themselves, as the current flowing through arm 19 is opposite the polarities flowing through the ends of current input conductors 22 and 24 (due to the reverse half-loops). Under normal operating load, the repelling force produced by the opposite polarities is insufficient to rotate arm 19 and disengage movable contacts 18 and 20 from stationary contacts 12 and 14 due to the inclusion of biasing springs (not shown) which are mounted between bridge 16 and contact arm 19 as described in U.S. patent application Ser. No. 09/087,038, and counteract the counter-clockwise force applied due to the opposite polarities of the current flowing through the circuit breaker 10, an operating mechanism assembly 25 biases the contact bridge 16 to rotate in a clockwise manner. The tensioning force applied by the biasing springs to the contact arm 19 determines the magnitude of the current required to rotate contact arm 19, thus clearing the overload condition within the circuit.

Figure 2:
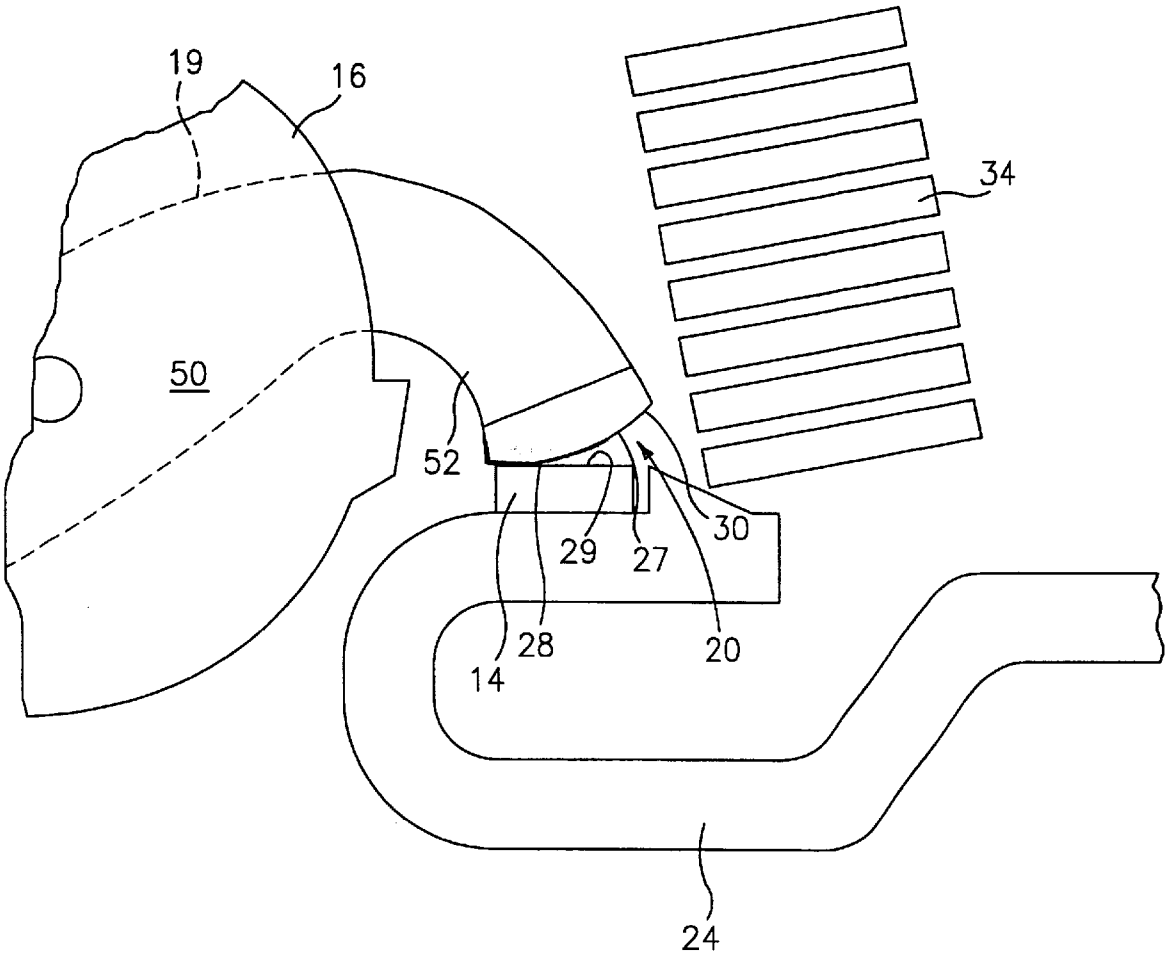
FIG. 2 is an enlarged partial diagrammatic side elevational view of one of the contact pairs of the circuit breaker of FIG. 1.
Figure 3:
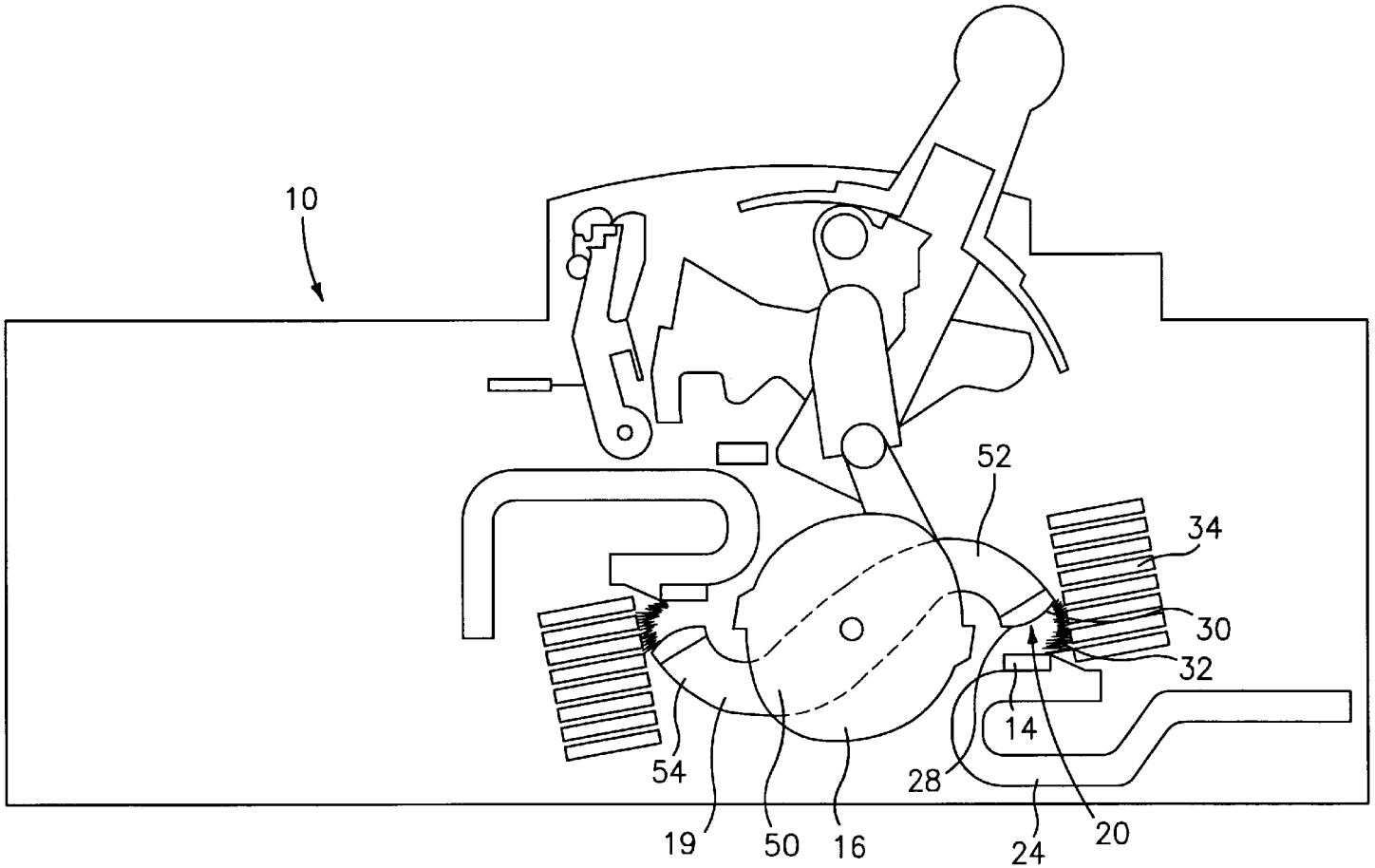
FIG. 3 is a diagrammatic side elevational view of the circuit breaker of FIG. 1 as the contact bridge rotates toward the open position.
Figure 4:
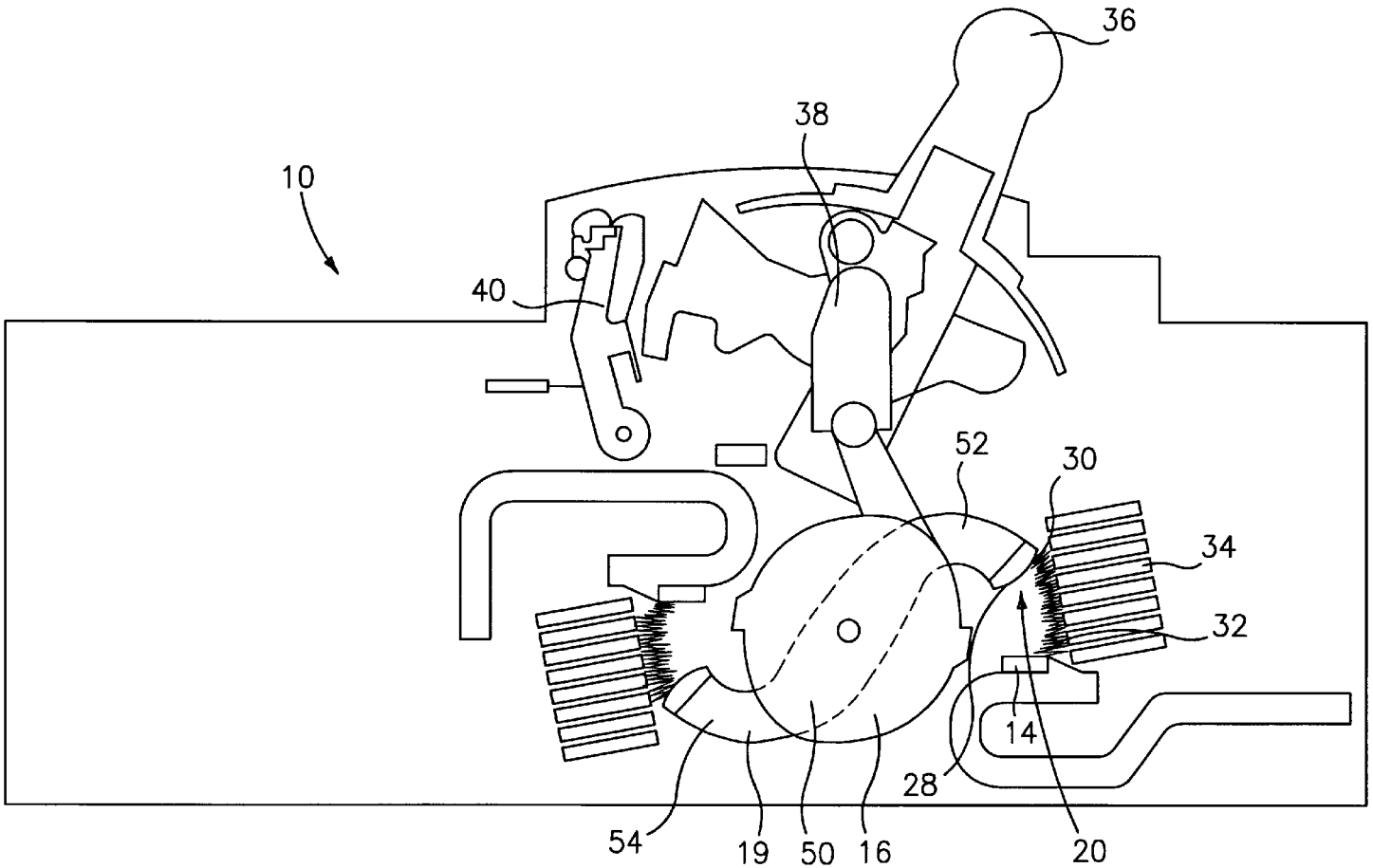
FIG. 4 is a diagrammatic side elevational view of the circuit breaker of FIG. 1 with the contact bridge in the open position.

Referring also to FIG. 2, an enlarged side elevational view of the stationary contact 14 and moveable contact 20 on contact arm 19 is provided. It will be appreciated that the operation and features of stationary contact 14, movable contact 20, and current input connectors 24 applies equally to stationary contact 12, movable contact 18, and current input connector 22 on the opposite side of contact arm 19. Movable contact 20 is constructed of an electrically conductive material, with a contact surface 27 thereof be disposed (positioned) at an angle (which may be achieved with a curved or arcuate surface 27) relative to a contact surface 29 of the mating stationary contact 14 when in a closed position (as best shown in FIG. 2). Movable contact 20 has a heel portion 28 and a toe portion 30. When the rotatable contact bridge 16 is in the closed position, the heel portion 28 of movable contact 20 contacts stationary contact 14. Electrical current is conducted through this contact. The impetus for the opening under overload conditions of the circuit breaker 10 is ordinarily a power surge through the circuit breaker 10 which momentarily increases the repelling force between stationary contact 12 and 14 and movable contacts 18 and 20, the repelling force being of greater magnitude than the force provided by the aforementioned biasing springs. Therefore, rotatable contact arm 19 rotates to disengage movable contacts 18 and 20 from stationary contacts 12 and 14 and the electrical circuit is broken, as is shown in FIGS. 3 and 4 . It is to be noted that in FIGS. 3 and 4, the operating mechanism assembly 25 is in a tripped position. The mechanism assembly in this position will rotate the contact bridge 16 to the counter clockwise position as shown. The operating mechanism assembly is similar to that of U.S. Pat. No. 5,281,776, which is incorporated herein by reference, and under overload conditions will go to a tripped position thru its interaction with a trip unit (although not shown, it is similar to that of U.S. Pat. No. 4,884,048, which is also incorporated herein by reference. The operating mechanism assembly includes a handle 36, linkage assembly 38 and reset later assembly 40 as are well known (U.S. Pat. No. 5,281,776). Once the rotatable contact arm 19 is rotated to disengage movable contacts 18 and 20 from stationary contacts 12 and 14, operating mechanism assembly 25 prevents the rotatable contact bridge 16 and contact arm 19 from returning to its closed position.

The useful lifespan of a circuit breaker is generally dependent upon the amount of erosion and wear of the movable contacts. In the prior art, as the contacts wear, the circuit breaker becomes less reliable and for the continued safe operation of the circuit, replacement of the circuit breaker becomes necessary. Also, as a result of this erosion there is an increase in temperature within the circuit breaker, such being indicative of increased resistance between the contacts. The present invention, by reducing the amount of erosion, advantageously reduces this increase in temperature resulting from erosion. The erosion of the movable contacts is generally caused by the electrical arc generated when the movable contacts separate form the stationary contacts and, particularly in the case of large power surges in which the current arc may traverse a relatively wide air gap between the movable contacts and the stationary contacts as the circuit breaker is being tripped. The scorching and erosion of the conductive material of the movable contacts degrades the contact between the movable contacts and the stationary contacts until finally the circuit breaker fails to perform as intended.

The present invention is designed to protect the contact portion of the movable contact 20 from erosion and/or scorching by "running" the arc off of the heel portion 28 of movable contact 20 onto toe portion 30 and into an arc chute 34, which dissipates the arc as is well known. The angle or curve of the movable contact 20 of the present invention operates in the following manner.

Referring now to FIGS. 3 and 4, the opening of circuit breaker 10 is illustrated. When a current overload occurs, moveable contacts 18 and 20 are forced apart from stationary contacts 12 and 14 and, depending upon the magnitude of the current overload, an electrical arc 32 forms between the separated contact parts 12 and 18, 14 and 20. In a standard rotary-double break circuit breaker, the electrical arc would extend generally between the stationary contact 14 and the movable contact 20 at the point where the movable contact 20 and stationary contact 14 engage one another when the contact arm 19 is in the closed position. As was discussed previously, this is undesirable due to the erosion of the movable contact 20 at the location of contact with stationary contact 14. The angled or curved movable contact 20 of the present invention causes electrical arc 32 to be moved (or drawn) towards the toe portion 30 of movable contact 20 as movable contact 20 is separated from stationary contact 14. As the air gap between the stationary contact 14 and movable contact 20 increases (FIGS. 3 and 4), the arc moves outwards towards the arc chute 34 and the arc continues to move (or be drawn) towards the toe portion 30 of movable contact 20. This movement of the arc minimizes the amount of damage of the portion of the contact that carries the current when the contact bridge 16 is in the closed position, i.e., the heel portion 28 of movable contact 20. The toe portion 30 of movable contact 20 is designed to gradually erode each time the circuit breaker 10 is opened, yet this erosion of the toe portion 30 permits the heel portion 28 to remain generally intact and thereby be protected from damage which could degrade the performance of the circuit breaker 10. Finally, when the air gap between movable contact 20 and stationary contact 14 is approaching its maximum amount (FIG. 4), arc blowout occurs in the direction of the arc chute 34 and the current overload is safely dissipated. It will be appreciated that the slope of the angled (or profile of the curved) surface of the movable contact 20 may be modified or changed provided that the electric arc formed during the circuit breaker opening is moved outwards towards the toe portion of the movable contact as the rotatable contact arm is moving the movable contact and stationary contact apart from one another.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A circuit breaker comprising:

a rotatable contact arm having a central section having a first longitudinal axis, a first connecting arm having a second longitudinal axis intersecting the first longitudinal axis, said first connecting arm extending angularly from said central section, said first and second longitudinal axes lie in a first plane;

a first fixed contact having a contact surface; and a first movable contact arranged at an end of said first connecting arm and having a contact surface positioned relative to the contact surface of the first fixed contact, said contact surface of said first movable contact having a heel portion and a toe portion, said contact surface of said first movable contact having a length located in the first plane and said first connecting arm having a length located in the first plane, said length of said first movable contact extends across the length of said first connecting arm;

wherein when said first movable contact and said first fixed contact are in a closed position, said heel portion of said first movable contact engages said contact surface of said first fixed contact and said toe portion of said first movable contact is spaced from said contact surface of said first fixed contact, and when said first movable contact and said first fixed contact are separated, an arc formed between said heel portion of said first movable contact and said contact surface of said first fixed contact is drawn from said heel portion of said first movable contact towards said toe portion of said first movable contact, the arc extends between said toe portion of said first movable contact and said first fixed contact.

2. The circuit breaker of claim 1 wherein said heel portion having a heel surface and said toe portion having a toe surface, said heel surface and said toe surface forms said contact surface of said first movable contact;

wherein said heel surface and said toe surface are contiguous and located in a second plane, the second plane intersecting the first plane.

3. The circuit breaker of claim 2 wherein said heel portion of said second movable contact having a heel surface and said toe portion of said second movable contact having a toe surface, said heel and toe surfaces of said second movable contact forms said contact surface of said second movable contact;

wherein said heel and toe surfaces of said second movable contact are contiguous and located in the second plane.

4. The circuit breaker of claim 1 wherein said first movable contact having a major axis located in the first plane and a projected length along the major axis;

wherein the projected length of said first movable contact extends across the length of said first connecting arm.

5. The circuit breaker of claim 1 including:

a second connecting arm having a third longitudinal axis intersecting the first longitudinal axis, said second connecting arm extending angularly from said central section in a direction diagonally opposite said first connecting arm, said first, second and third longitudinal axes lie in the first plane;

a second fixed contact having a contact surface; and a second movable contact arranged at an end of said second connecting arm and having a contact surface positioned relative to the contact surface of the second fixed contact, said contact surface of said second movable contact having a heel portion and a toe portion, said contact surface of said second movable contact having a length located in the first plane and said second connecting arm having a length located in the first plane, said length of said second movable contact extends across the length of said second connecting arm;

wherein when said second movable contact and said second fixed contact are in a closed position, said heel portion of said second movable contact engages said contact surface of said second fixed contact and said toe portion of said second movable contact is spaced from said contact surface of said second fixed contact, and when said second movable contact and said second fixed contact are separated, an arc formed between said heel portion of said second movable contact and said contact surface of said second contact is drawn from said heel portion of said second movable contact towards said toe portion of said second movable contact, the arc extends between said toe portion of said second movable contact and said second fixed contact.

6. The circuit breaker of claim 5 wherein said contact surface of said first movable contact is arcuate and said contact surface of said second movable contact is arcuate.

7. The circuit breaker of claim 5 wherein said lengths of said first and second connecting arms and said first and second movable contacts is crosswise.

8. The circuit breaker of claim 5 wherein said second movable contact having a major axis located in the first plane and a projected length along the major axis;

wherein the projected length of said second movable contact extends across the length of said second connecting arm.

9. The circuit breaker of claim 5 including:

a first arc chute positioned adjacent said first movable contact and said first fixed contact; and a second arc chute positioned adjacent said second movable contact and said second fixed contact;

wherein when the first movable contact is separated from said first fixed contact, the arc extends between said toe portion of said first movable contact and said contact surface of said first fixed contact and into said first arc chute and when said second movable contact is separated from said second fixed contact an arc extends between said toe portion of said second movable contact and said contact surface of said second fixed contact and into said second arc chute.

10. A circuit breaker comprising:

a rotatable contact arm having a central section with a first longitudinal axis, a first connecting arm having a second longitudinal axis intersecting the first longitudinal axis, said first connecting arm extending angularly from said central section, said first and second longitudinal axes lie in a first plane;

a first fixed contact having a contact surface; and a first movable contact arranged at an end of said first connecting arm and having a contact surface positioned relative to the contact surface of the first fixed contact, said contact surface of said first movable contact having a heel portion and a toe portion, said contact surface of said first movable contact having a length located in the first plane and said first connecting arm having a length located in the first plane, said length of said first connecting arm is less than the length of said first movable contact;

wherein when said first fixed contact and said first movable contact are in a closed position, said heel portion of said first movable contact engages said contact surface of said first fixed contact and said toe portion of said first movable contact is spaced from said contact surface of said first fixed contact, and when said first movable contact and said first fixed contact are separated, an arc formed between said heel portion of said first movable contact and said contact surface of said first fixed contact is drawn from said heel portion of said first movable contact towards said toe portion of said first movable contact, the arc extends between said toe portion of said first movable contact and said first fixed contact.

11. The circuit breaker of claim 10 including:

a second connecting arm having a third longitudinal axis intersecting the first longitudinal axis, said second connecting arm extending angularly from said central section in a direction diagonally opposite said first connecting arm, said first, second and third longitudinal axes lie in the first plane;

a second fixed contact having a contact surface; and a second movable contact arranged at an end of said second connecting arm and having a contact surface positioned relative to the contact surface of the second fixed contact, said contact surface of said second movable contact having a heel portion and a toe portion, said contact surface of said second movable contact having a length located in the first plane and said second connecting arm having a length located in the first plane, said length of said second connecting arm is less than the length of said second movable contact;

wherein when said second fixed contact and said second movable contact are in a closed position, said heel portion of said second movable contact engages said contact surface of said second fixed contact and said toe portion of said second movable contact is spaced from said contact surface of said second fixed contact, and when said second movable contact and said second fixed contact are separated, an arc formed between said heel portion of said second movable contact and said contact surface of said second contact is drawn from said heel portion of said second movable contact towards said toe portion of said second movable contact, the arc extends between said toe portion of said second movable contact and said second fixed contact.

12. The circuit breaker of claim 11 wherein said lengths of said first and second connecting arms and said first and second movable contacts is crosswise.

13. The circuit breaker of claim 11 wherein said contact surface of said first movable contact is arcuate and said contact surface of said second movable contact is arcuate.

14. A rotary contact arm assembly comprising:

a rotatable contact arm having a central section with a first longitudinal axis, a first connecting arm having a second longitudinal axis intersecting the first longitudinal axis, said first connecting arm extending angularly from said central section, said first and second longitudinal axes lie in a first plane;

a first fixed contact having a contact surface; and a first movable contact arranged at an end of said first connecting arm and having a contact surface positioned relative to the contact surface of the first fixed contact, said contact surface of said first movable contact having a heel portion and a toe portion, said contact surface of said first movable contact having a length located in the first plane and said first connecting arm having a length located in the first plane, said length of said first connecting arm is less than the length of said first movable contact;

wherein when said first fixed contact and said first movable contact are in a closed position, said heel portion of said first movable contact engages said contact surface of said first fixed contact and said toe portion of said first movable contact is spaced from said contact surface of said first fixed contact, and when said first movable contact and said first fixed contact are separated, an arc formed between said heel portion of said first movable contact and said contact surface of said first fixed contact is drawn from said heel portion of said first movable contact towards said toe portion of said first movable contact, the arc extends between said toe portion of said first movable contact and said first fixed contact.

15. The rotary contact arm assembly of claim 14 including:

a second connecting arm having a third longitudinal axis intersecting the first longitudinal axis, said second connecting arm extending angularly from said central section in a direction diagonally opposite said first connecting arm, said first, second and third longitudinal axes lie in the first plane;

a second fixed contact having a contact surface; and a second movable contact arranged at an end of said second connecting arm and having a contact surface positioned relative to the contact surface of the second fixed contact, said contact surface of said second movable contact having a heel portion and a toe portion, said contact surface of said second movable contact having a length located in the first plane and said second connecting arm having a length located in the first plane, said length of said second connecting arm is less than the length of said second movable contact;

wherein when said second fixed contact and said second movable contact are in a closed position, said heel portion of said second movable contact engages said contact surface of said second fixed contact and said toe portion of said second movable contact is spaced from said contact surface of said second fixed contact, and when said second movable contact and said second fixed contact are separated, an arc formed between said heel portion of said second movable contact and said contact surface of said second contact is drawn from said heel portion of said second movable contact towards said toe portion of said second movable contact, the arc extends between said toe portion of said second movable contact and said second fixed contact.

16. The rotary contact arm assembly of claim 15 wherein said contact surface of said first movable contact is arcuate and said contact surface of said second movable contact is arcuate.

17. The rotary contact arm assembly of claim 15 wherein said lengths of said first and second connecting arms and said first and second movable contacts is crosswise.

* * * * *